United States Patent [19]

Jennings et al.

[11] 4,058,045

[45] Nov. 15, 1977

[54] PIANO WITH SOUND-ENHANCING SYSTEM

[75] Inventors: Robert Parry Jennings, Castro Valley; Kenneth Thomas Aaroe, Hayward, both of Calif.

[73] Assignee: Solosonic, Hayward, Calif.

[21] Appl. No.: 655,451

[22] Filed: Feb. 5, 1976

[51] Int. Cl.[2] ..... G10H 1/00; G10H 3/02

[52] U.S. Cl. ..... 84/1.14; 84/1.09; 84/1.16; 84/1.27; 84/DIG. 1; 84/DIG. 24

[58] Field of Search ..... 84/1.04, 1.06, 1.09, 84/1.1, 1.14–1.16, 1.27, DIG. 1, DIG. 24, DIG. 27; 179/1 E, 1 G, 1 GA; 310/8–8.7

[56] References Cited

U.S. PATENT DOCUMENTS

| | | | |
|---|---|---|---|
| 2,001,392 | 5/1935 | Miessner | 84/1.14 X |
| 2,045,917 | 6/1936 | Miessner | 84/1.14 X |
| 2,513,109 | 6/1950 | Roth | 84/DIG. 1 |
| 2,530,252 | 11/1950 | Luberoff | 84/1.16 |
| 2,856,805 | 10/1958 | Babicky | 84/1.04 |
| 3,429,976 | 2/1969 | Tomcik | 84/1.04 X |
| 3,553,336 | 1/1971 | Markowitz | 84/1.09 |

*Primary Examiner*—Stanley J. Witkowski
*Attorney, Agent, or Firm*—Owen, Wichersham & Erickson

[57] ABSTRACT

A piano having a sound-enhancing system incorporating transducers, amplifiers and loud speakers, all incorporated into or upon the piano.

18 Claims, 5 Drawing Figures

FIG. 1
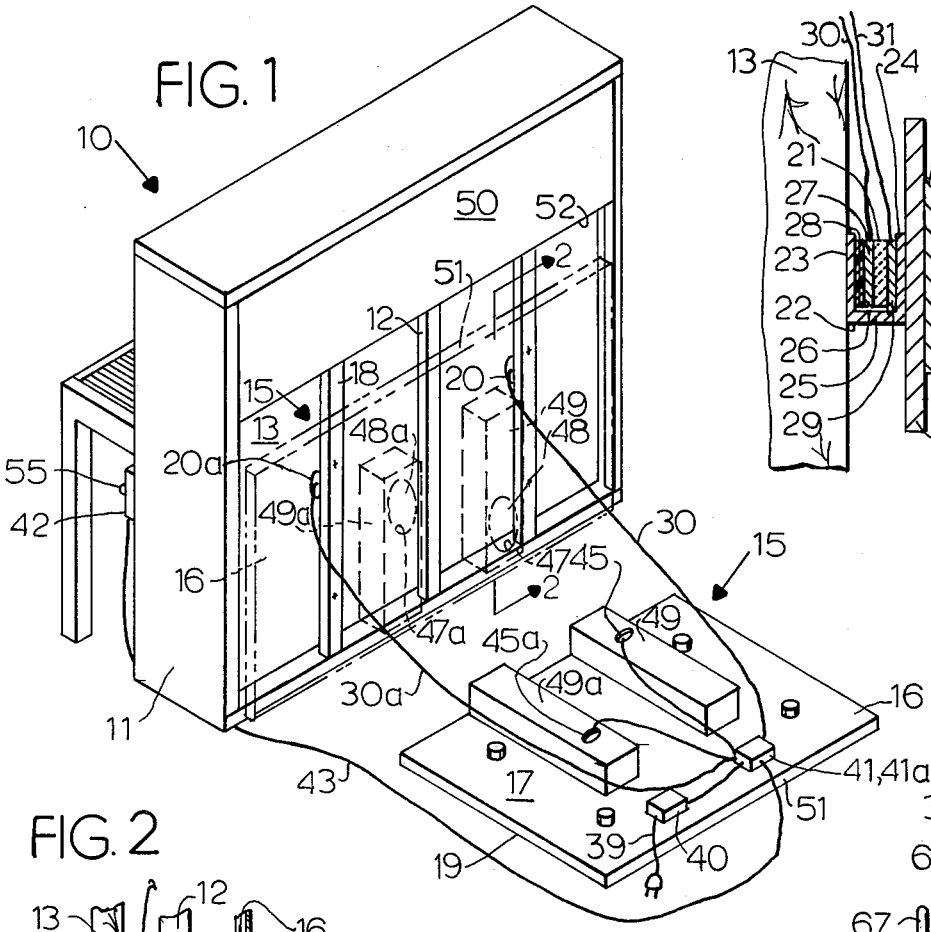
FIG. 3
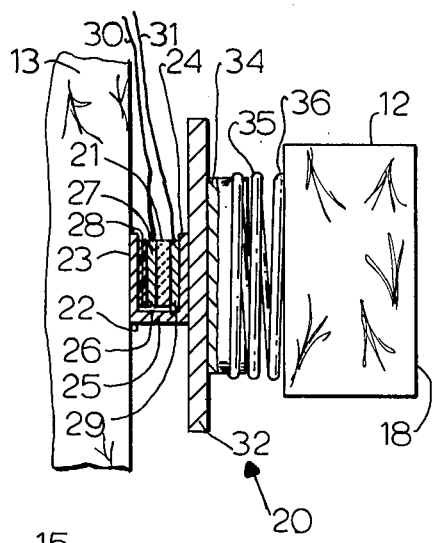
FIG. 2
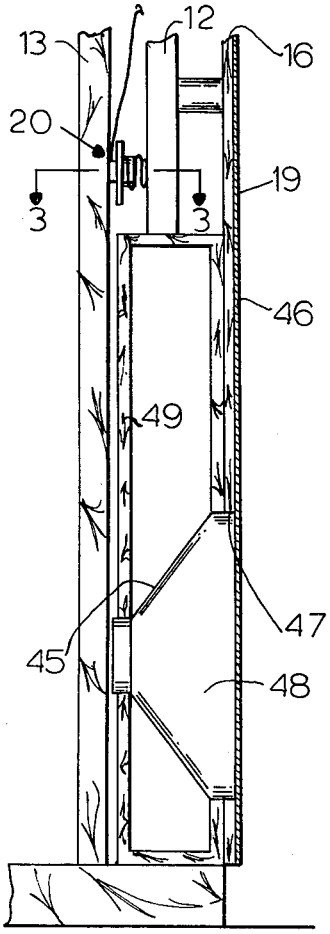
FIG. 5
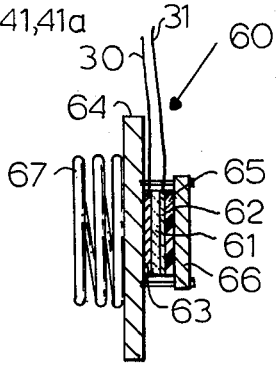
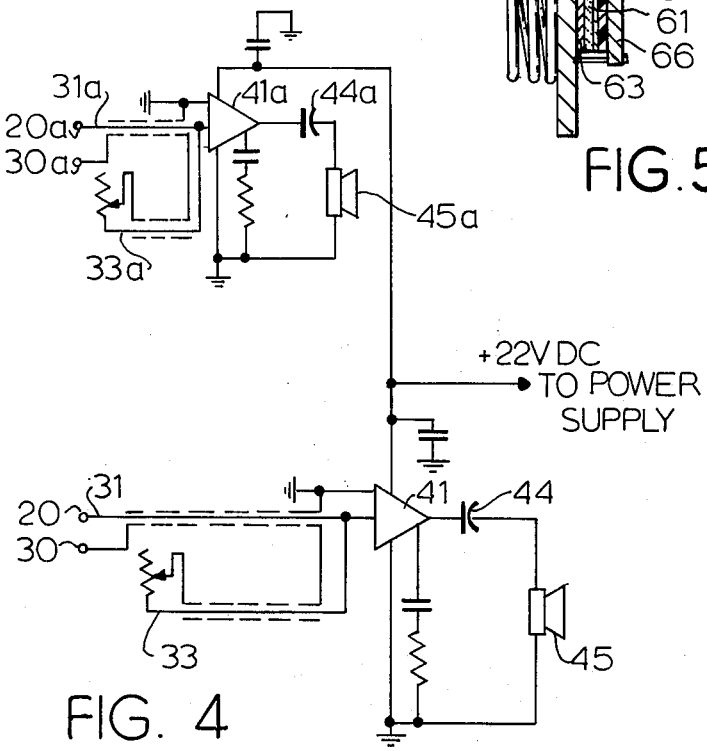
FIG. 4

PIANO WITH SOUND-ENHANCING SYSTEM

BACKGROUND OF THE INVENTION

This invention relates to a piano provided with a sound-enhancing system.

Pianos of the upright type and particularly those of so-called spinet type are not noted for the quality of their sound. In comparison with the fine concert grand or even of a baby grand of distinguished manufacture, the spinet upright pianos give forth a relatively pale sound. Yet, many people living in relatively cramped quarters or with relatively small incomes, can neither afford the really fine pianos nor find a place to put them.

An important object of the present invention is to provide a piano of the upright spinet type with a sound-enhancing system which makes it sound far better to most hearers, even though it is small and located probably in a small room up against a wall.

A problem solved by the present invention is to impart to such a small, relatively inexpensive piano a quality of sound that sounds greatly better to most people.

Heretofore, pickups have been mounted on pianos with an amplifier completely separate from them, usually a large and unwieldly device and with a large loud speaker which had to be set somewhere else in the room. This is no great advantage to one having cramped space. When pickups, amplifiers, and loudspeakers have been mounted inside the piano, they have involved major reconstruction of the piano and have taken up a large amount of space. Moreover, usually they have been adapted to grand pianos rather than to small uprights.

Furthermore, when one attempts to apply amplification to a piano, one encounters a feedback problem. The output from the loudspeakers tends to act on the sounding board of the piano to produce sound there which distorts the tone of the piano and results in further feedback to affect the sounding board and produce further distortion.

Another type of feedback tends to result when ordinary microphones are installed in a piano, and, once again, significant tone distortion results, so that the final sound output is quite unsatisfactory.

This invention combines an already-manufactured piano with an electronic pickup, amplification, and speaker system that increases the volume or sound and apparently its quality also.

SUMMARY OF THE INVENTION

In the present invention the piano is not rebuilt, but is used as it is with the enhancing system very simply installed on it.

The invention provides an electronic amplifying and speaker assembly having a support and baffle board that may be secured to the rear face of the upright frame members which lie at the rear of an upright spinet piano, back of the sounding board. Such a board may also be used with a grand piano, usually below the sounding board. The support board carries at least the amplifiers and loud speakers. In some instances, it may also support the pickups or microphones, but in a preferred form of the invention a novel pickup system is employed wherein a weighted backup is combined with a ceramic piezoelectric pickup, in conjunction with an assembly which is spring-urged against the sounding board, so that the pickup assembly picks up its sound from the sounding board. The sounding board and loudspeaker enclosures baffle the sound therefrom to prevent feedback to the sounding board. The result is to give a greatly improved type of amplification to a piano.

A volume control may be provided located at the front of the piano to enable the player to regulate the volume to his taste and that of his listeners and to the size and the acoustical quality of the room.

Other objects and advantages of the invention will appear from the following description of a preferred embodiment.

BRIEF DESCRIPTION OF THE DRAWINGS

In the drawings:

FIG. 1 is a view in perspective, looking from the rear, of an upright spinet piano with an installation embodying the principles of the invention added thereto. The added installation is shown in solid lines taken off the back and placed on the floor for better viewing. In broken lines, the enhancing unit is shown installed.

FIG. 2 is a view in section, somewhat enlarged, taken along the line 2—2 in FIG. 1.

FIG. 3 is a further enlarged view in section taken along the line 3—3 in FIG. 2.

FIG. 4 is a circuit diagram for one of the loudspeaker amplifier systems.

FIG. 5 is a view of a modified form of piezoelectric pickup assembly useful in the invention.

DESCRIPTION OF A PREFERRED EMBODIMENT

A piano 10 of the upright spinet type is shown in FIG. 1. The invention applies to other uprights and to grand (horizontal) pianos, and this piano 10 is but an example of a type of piano where the invention has applicability and is especially useful. The piano 10 has the usual keyboard with keys and a string-holding frame with strings which is mounted inside the main piano frame 11, and the usual array of hammers, dampers, release mechanisms, and so on are, of course, present. The piano 10 is simply a typical standard spinet-type upright piano. No special manufacture is required.

The frame 11 of such pianos includes a pair of spaced uprights 12 at the rear of the piano and to the rear of a sounding board 13. The uprights 12 extend from the bottom to the top, and they are spaced away from the sounding board 13.

The present invention comprises an amplifying assembly 15, most of which is mounted on a support and baffling board 16, and the support and baffling board 16 (in this illustrative embodiment) has its support face 17 secured to the rear faces 18 of some of the uprights 12. In this way, practically everything of the completed device lies inside the piano 10, and the depth of the piano 10 is extended for only the thickness of the board 16, which may be three-quarters of an inch, for example. There is a second or rear face 19 on the board 16. No special type of board need be used, a good plywood is satisfactory.

The board 16 may support a plurality of suitable transducers, but we have found that especially good results at low prices can be obtained from a novel installation of a ceramic (piezoelectric) pickup assembly 20, shown in FIGS. 2 and 3. Electrodynamic transducers may be used, if they do not cause objectionable feedback, and capacitor pickups may be used, but, so far, the best results are obtained by a piezoelectric device which is also less expensive than most transducers. The assembly 20 employs a ceramic pickup 21 in combination with a spring retaining device to hold it in place and an inertial mass to dampen the spring motion so as to increase its electrical output; this assembly 20 is preferably pressed against the sounding board 13 in order to get its sound therefrom.

Thus, FIG. 3 shows a ceramic (piezoelectric) pickup 21 which is supported in a holder 22, which may be described as a metal housing having a front plate 23 and a rear plate 24 joined by a portion 25. In between the two plates 23 and 24 is a space 26 containing the pickup 21, with a conductive metal plate 27 on one side and one or more insulators 28 to insulate the pickup 21 and the plate 27 from the front plate 23, and a conductive metal plate 29 in contact with the opposite face of the pickup 21 and the rear plate 24. Suitable leads 30 and 31 are connected to the plates 27 and 29. The insulators 28 and the plates 27 and 29 are sized so that the plates 27 and 29 engage the pickup 21 snugly and with a little pressure, and are also snug in the holder 22, with a little pressure on the plates 23 and 24. Only one side of the pickup 21 is in electrical contact with the holder 22.

The pickup holder 22 is itself preferably secured rigidly to a backup plate 32 of substantial inertial mass, which may be a large, heavy, circular metal disc, either single or laminated. The rear of the backup plate 32 may be provided with a spring mounting member 34, and a spring 35, preferably a coil-type spring, is supported thereon and bears against the forward face 36 of one of the uprights 12. The spring 35 is so sized and tensed as to force the pickup holder 22 firmly against the sounding board 13, while the inertial mass 32 dampens the vibrational effect of sound on the spring 35 and, in effect, holds the piezoelectric crystal 21 substantially stationary, thereby greatly increasing its electrical output. There may be two, or more than two, of these pickup assemblies 20. Preferably there are at least two assemblies 20 so that the treble and bass portions of the piano are adequately covered, and there may be more than two if that is desired.

As shown in FIGS. 1 and 4, each pickup 20 and **20*a* is connected by its leads 30 and 31 or 30*a* and 31*a* to the amplifier circuit where there is an amplifier 41 and an amplifier 41*a*. A volume control 42 may be provided as a rheostat connected by a lead 43 to the amplifiers 41, 41*a*, which are, in turn, connected to a power supply 40 having a power supply cord 39, the volume control 42 being used to vary the resistance and therefore change the ultimate output. This volume control 42 may be secured to the front of the piano 10**, either low down where it is less conspicuous or above the keyboard if that is desired. There is no reason for having it located any particular place so long as it is within reach conveniently of the pianist.

Each amplifier 41 or **41*a* may be coupled by a suitable capacitance coupling 44 or 44*a*, as shown in FIG. 4, to a loud speaker 45 or 45*a* and may be supplied with power from a suitable power supply. Typically, a power supply unit 44 is set up to supply dc current at about twenty-two volts and, of course, this may be done with the usual transformer and rectifier type of circuit. The amplifiers 41 and 41*a* thus are respectively connected to the loud speakers 45 and 45*a* and these, like the amplifier circuits, are mounted on the support and baffle board 16. Openings 47 and 47*a* are cut through the support and baffle board 16 opposite the cones 48 and 48*a* of the loud speakers 45 and 45*a* to permit the sound to come out; that is, the column of air which transmits the sound is not interferred with by having the cone 48 up against the board 16. Preferably, a grille cloth 46 is placed over the board 16 or over the entire back of the piano, as may be desired. This is largely for looks, but it also helps to protect the loud speakers 45 and 45*a*** from damage.

The board 16 is made only slightly smaller than the area at the back of the piano 10 (or than the bottom of a grand piano) which is open to the sounding board 13. The loudspeakers 45 and **45*a* are in enclosures 49 and 49*a* open only when the cones 48 and 48*a* are seated in the openings 47 and 47*a*. As a result, the board 16 baffles the sound coming from the loudspeakers 45 and 45*a* from the sounding board 13 sufficiently to prevent feedback there. This is quite important, the exact size may have to be determined experimentally for any particular piano, but this can be done readily, and the drawing gives a general guide. For a spinet piano having an open area below the backboard 50 (See FIG. 1) of 4′6″ × 3′4″, normally fully open, we use a baffle board 16 which is 4′ × 2′8″ inches, leaving a clearance of 6 inches at the top between the top edge 51 of the board 16 and the bottom edge 52 of the board 50 and a clearance of 4** inches at each side to enable one's hands to get at the moving rods. There need be no clearance at the bottom.

The pianist plays the piano as usual, setting the volume control 42 where he desires. An on-off switch 55 is provided to conserve electric current, and all the pianist has to do is to turn this switch 55 on, once the volume is set, it usually is sufficient to leave it that way. However, if there is a party going on and it is desired to increase the amplification this may be done by using the volume control 42, or if one is using it later at night and wishes to avoid disturbing neighbors, the volume control 42 may be turned lower, or the device may be turned off all together if no enhancement is desired.

FIG. 5 shows a modified form of pickup assembly 60. Here, a piezoelectric pickup 61, preferably ceramic, is sandwiched between front and rear conducting plates 62 and 63. The rear conducting plate 63 lies against a heavy plate 64 or disc of lead or other suitable inertial material.

The front conducting plate 62 is separated by an insulating plate 65 from a front disc or plate 66, which may be of aluminum and which bears directly against the sounding board 13. A spring 67 lies against the inertial plate 64 and bears against a post 12. Again, the inertial mass of the plate 64 improves the output of the pickup assembly 60 by dampening the spring 67.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. In a piano having a main frame, a string-holding frame supported by and inside said main frame and having strings thereon, a keyboard with keys, and a sounding board, the combination therewith of:

an amplifying assembly, comprising pickup means mounted on said sounding board for picking up sound directly from said sounding board supported on said piano, amplifier means supported on said piano and connected electrically to said pickup means, loud speaker means supported on said piano and electrically connected to said amplifier means, and baffle means secured to said piano main frame for preventing feedback from said loudspeaker means to said sounding board, said amplifier means and said loudspeaker means being secured to and supported by said baffle means.

2. The combination of claim 1 incorporating volume control means mounted on the piano adjacent the keyboard and connected electrically to said amplifier means.

3. The combination of claim 1 having baffle means between said loudspeaker means and said sounding board for preventing feedback from said loudspeaker means to said sounding board and resultant tone distortion.

4. The combination of claim 1 wherein said pickup means comprises at least one piezoelectric pickup in a housing that is in direct contact with said sounding board.

5. In a piano having a main frame, a string-holding frame supported by and inside said main frame and having strings thereon, a keyboard with keys, and a sounding board, the combination therewith of:

an amplifying assembly, comprising pickup means mounted on said sounding board for picking up sound directly from said sounding board supported on said piano, amplifier means supported on said piano and connected electrically to said pickup means, loud speaker means supported on said piano and electrically connected to said amplifier means, and baffle means for preventing feedback from said loudspeaker means to said sounding board, said pickup means comprising at least one piezoelectric pickup in a housing that is in direct contact with said sounding board, said housing having a front plate and a rear plate spaced apart with said piezoelectric pickup in between them and in electrical contact with one said plate, and insulator means filling the space between said piezoelectric pickup and the other said plate.

6. The combination of claim 5 having a backup member of substantial mass secured to said housing, and spring means for urging said front plate against said sounding board, the mass of said backup member preventing said piezoelectric pickup from moving with the movement of said sounding board, thereby substantially increasing the electrical output from said piezoelectric pickup.

7. In a piano having a main frame with a string-holding frame supported by and inside said main frame and having strings thereon, a keyboard at the front with keys, and a sounding board, an amplifying assembly, comprising a support and baffle board secured to said piano and having a support face facing said sounding board and a second face, a plurality of pickup means positioned between said sounding board and said support board, in contact with said sounding board, and spaced apart from each other to pick up different frequency ranges of the piano, a plurality of amplifier means corresponding in number to said pickup means, supported on the support face of said support board and each connected electrically to a said pickup means, and a plurality of enclosed loud speakers corresponding in number to said amplifier means, supported by said support face and each electrically connected to a said amplifier means, said support board having an opening therethrough for an output area of each said loudspeaker, said support board being so positioned relative to said loudspeakers and said sounding board and of such a size as to serve as a baffle preventing feedback from said loudspeaker to said sounding board.

8. The combination of claim 7 incorporating volume control means mounted on the front of said piano and connected electrically to said amplifier means.

9. The combination of claim 7 wherein each said pickup means comprises a piezoelectric pickup in a housing that is in direct contact with said sounding board.

10. The combination of claim 9 having a backup member of substantial mass secured to said housing and having spring support means for holding said pickup housing against said sounding board, said mass serving to dampen the tendency of said spring means to be vibrated by the sound from said sounding board.

11. In an upright piano having a main frame with a front and a rear, sides and a top, a string-holding frame supported by and inside said main frame and having strings thereon, a keyboard at the front with keys, and a vertical sounding board to the rear of said string-holding frame, said main frame having a plurality of uprights to the rear of and spaced from said sounding board and having front faces facing said sounding board and rear faces lying on a common plane, the combination therewith of:

an amplifying assembly, comprising a support and baffle board secured to the rear faces of some of said uprights in a vertical position and having a support face facing said sounding board and a rear face, a plurality of pickup means positioned between said sounding board and said support board and spaced apart from each other to pick up different frequency ranges of the piano, a plurality of amplifier means corresponding in number to said pickup means, supported on the support face of said support board and each connected electrically to a said pickup means, a plurality of enclosed loud speakers corresponding in number to said amplifier means, supported by said support face of said support board and each electrically connected to a said amplifier means, said support board having an opening therethrough for an output area of each said loudspeaker and being so located and sized as to baffle the feedback of sound from each loudspeaker to the sounding board, and a power-supply cord for said amplifier means and loudspeaker means, extending out from said support board.

12. The combination of claim 11 incorporating volume control means mounted on the front of said piano adjacent to the keyboard and connected electrically to said amplifier means.

13. The combination of claim 11, wherein there are two said pickup means, two said amplifier means, and two said loudspeaker means, one of each generally for the treble range and the other of each generally for the bass range.

14. The combination of claim 11 wherein each said pickup means comprises a ceramic piezoelectric pickup in a housing that is in direct contact with said sounding board.

15. The combination of claim 14 wherein said housing has a front plate and a rear plate spaced apart from each other with said ceramic pickup in between them and in electrical contact with one said plate, and insulator means in between said ceramic pickup and the other said plate.

16. The combination of claim 15 having a backup member of substantial mass secured to the plate with which said pickup is in electrical contact, and a coil spring seated on said backup member and engaging the front face of a said upright and urging said front plate against said sounding board, the mass of said backup member dampening vibration of said spring.

17. In an upright piano having a main frame with a front and a rear, sides and a top, a string-holding frame supported by and inside said main frame and having strings thereon, a keyboard at the front with keys, and a vertical sounding board to the rear of said string-holding frame, said main frame having a plurality of uprights to the rear of and spaced from said sounding board and having front faces facing said sounding board and rear faces lying on a common plane, the combination therewith of:

an amplifying assembly, comprising a support and baffle board secured to the rear faces of some of said uprights in a vertical position and having a support face facing said sounding board and a rear face, a plurality of pickup means, each comprising a ceramic piezoelectric pickup with a metal conductor engaging each side thereof, a metal housing having a front plate and a rear plate spaced apart with said ceramic pickup in between them and in electrical contact with said rear plate, insulator means between said ceramic pickup and said front plate, a backup member of substantial mass secured to said back plate, and a coil spring seated on said backup member and engaging the front face of a said upright and urging said front plate against said sounding board, said backup member dampening vibration of said spring, a plurality of amplifier means corresponding in number to said pickup means, supported on the support face of said support board and each connected electrically to a said pickup means, a plurality of enclosed loudspeakers corresponding in number to said amplifier means, supported by said support face of said support board and each electrically connected to a said amplifier means, said support board having an opening therethrough for an output area of each said loudspeaker and baffling between said loudspeakers and said sounding board to prevent feedback, a power-supply cord for said amplifier means and loudspeaker means, extending out from said support board, volume control means mounted on the front of said piano and connected electrically to said amplifier means, and grille cloth covering the rear face of said support board.

18. In a piano having a main frame, a string-holding frame supported by and inside said main frame and having strings thereon, a keyboard with keys, and a sounding board, the combination therewith of:

an amplifying assembly, comprising a plurality of pickup means for picking up sound from said sounding board supported on said piano, a plurality of amplifier means corresponding in number to said pickup means, supported on said piano and each connected electrically to a said pickup means, a plurality of loud speakers corresponding in number to said amplifier means, supported on said piano and each electrically connected to a said amplifier means, and baffle means for preventing feedback from said loudspeakers to said sounding board, each said pickup means comprising a piezoelectric pickup in a housing that is in direct contact with said sounding board, said housing having a front plate and a rear plate spaced apart with said piezoelectric pickup in between them and in electrical contact with one said plate, insulator means filling the space between said piezoelectric pickup and the other said plate, a backup member of substantial mass secured to said housing, and, spring means for urging said front plate against said sounding board, the mass of said backup member preventing said piezoelectric pickup from moving with the movement of said sounding board, thereby substantially increasing the electrical output from said piezoelectric pickup.

* * * * *